US006472948B1

(12) United States Patent
Kyriakos et al.

(10) Patent No.: US 6,472,948 B1
(45) Date of Patent: Oct. 29, 2002

(54) HIGH-POWER PRECISION 1 DB STEP ATTENUATOR

(75) Inventors: Constantinos S. Kyriakos, Indian Harbor Beach; James B. Ledebur; Leo G. Maloratsky, both of Indialantic; Carl E. Steen, Satellite Beach, all of FL (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/613,222

(22) Filed: Jul. 10, 2000

(51) Int. Cl.[7] ..... H01P 1/22

(52) U.S. Cl. ..... 333/81 R; 333/81 A; 327/306; 327/308

(58) Field of Search ..... 333/81 R, 81 A; 327/306, 308

(56) References Cited

U.S. PATENT DOCUMENTS 4,654,610 A * 3/1987 Dasilva ..... 333/81 R
5,347,239 A * 9/1994 Loehner et al. ..... 333/81 R
5,847,624 A * 12/1998 Pritchett ..... 333/81 R

* cited by examiner

*Primary Examiner*—Justin P. Bettendorf
*Assistant Examiner*—Damian E. Cathey
(74) *Attorney, Agent, or Firm*—Nathan O. Jensen; Kyle Eppele

(57) ABSTRACT

A step attenuator for use in attenuating an electromagnetic signal. The step attenuator includes a first path having a plurality of attenuator structures provided therein, each attenuator structure being selectively actuated to permit the signal to pass therethrough. A second path is disposed in parallel with the first path, the second path permitting the signal to selectively bypass the first path. A third path is disposed in series with the first and second paths and includes at least one attenuator structure that is selectively actuated to permit the signal to pass therethrough.

19 Claims, 3 Drawing Sheets

40
46
48
70
2 dB
4 dB
8 dB
16 dB
1 dB
a
b
t
42
44
50
52
54
56
58
60
62
64
66
68
72
74

46
48
70
2 dB
4 dB
8 dB
16 dB
1 dB
a
b
c
d
t
60
62
64
66
68
72
74

HIGH-POWER PRECISION 1 DB STEP ATTENUATOR

FIELD OF THE INVENTION

The present invention relates to methods of attenuating electromagnetic signals, and more particularly, to attenuation networks.

BACKGROUND OF THE INVENTION

Step attenuators are well known in the electronics industry. A common step attenuator has a number of individual attenuators, or attenuator cells, selectively connected in series. Each attenuator cell attenuates an input signal by a predetermined value, which is typically measured in decibels (dB). A step attenuator may be designed to include n attenuator cells having attenuation values of $2^k$ (dB), where k=0, 1, 2, . . . , n. An individual switch pair is provided for each attenuator cell. By opening and closing the switches, it is possible to select any given value of attenuation up to the sum of the attenuation of all of the attenuator cells.

FIG. 1 shows a known step attenuator 8 configured as described above. Five attenuator cells 11, 12, 13, 14, 15 are arranged in series between an input 10 and an output 19. Attenuator cells 11, 12, 13, 14, and 15 respectively have attenuation values of 1 dB, 2 dB, 4 dB, 8 dB, and 16 dB. Each attenuator cell employs a T- or π-connection of three resistors (not shown) which are selected to provide the desired attenuation and to equalize the input/output impedance of the attenuator cell with the input/output impedance of step attenuator 8. Attenuator cell 11 has two switches 16, 17 connected thereto. Switches 16, 17 are preferably single-pole double-throw type switches and direct an input signal either through attenuator cell 11 or through a bypass line 18, which bypasses the attenuator cell. Attenuator cells 12, 13, 14, 15 have similar switches and bypass lines such that control of the switches enables an operator to selectively connect any desired combination of switches, which in turn permits step attenuator 8 to attenuate a signal between 0 dB and 31 dB (in 1 dB steps) as desired.

One problem with step attenuator 8 is that significant losses are incurred in the switches and transmission lines (termed "insertion losses") even when the input signal does not pass through the attenuation cells. To solve this problem, another type of step attenuator has been developed, shown in FIG. 2, that includes a bypass line 22. When attenuation is desired, switches 20, 21 are positioned as shown in FIG. 2 to direct the input signal through the attenuator cells. When no attenuation is desired, switches 20, 21 are positioned to direct the input signal through bypass line 22. This arrangement reduces the insertion losses because the non-attenuated input signal does not pass through all of switches 17. However, such an arrangement does not address step error, which is also present in known step attenuators. Step error occurs when the difference between two attenuation levels is too small to differentiate between the levels. For instance, if the step error between attenuation levels 1 dB apart ("1 dB step error") is more than +/−0.5 dB, it will be difficult to tell which attenuation level is desired. To minimize 1 dB step error to less than +/−0.35 dB, bypass line 22 should be insulated from the line having the attenuator cells to a level of at least 70 dB. This may be accomplished by including a multiple diode circuit in each of switches 20, 21. However, the multiple diode circuit requires more area and increases the insertion losses in the attenuator such that the insertion loss through the switches is greater than 1.0 dB. The first 1 dB step, therefore, is difficult to attain.

In practical high-power applications of known step attenuator designs, further errors are introduced due to parasitic capacitances between the high-power resistors making up the attenuators and the underlying ground plane. Additional errors are caused by parasitic reactive components of high-power PIN diodes included in the attenuator design.

It is possible to miniaturize the design of a step attenuator by fabricating the attenuator from a stripline or microstrip line having a small dielectric substrate thickness and a high relative dielectric constant. Such a design of the diode sections and attenuator cells produce additional parasitic capacitances between the print circuits (or pads) of these elements and the underlying ground plane. To compensate for the parasitic capacitances or reactances, conventional step attenuators require additional tuning and matching elements, transformers, and reactive stubs. These additional components cause the step attenuators to have a narrow frequency bandwidth, occupy a larger area, and require more precise manufacturing tolerances due to the resulting increased sensitivity.

It is therefore an object of the invention to provide a step attenuator with a step error reduced so that each desired attenuation level is differentiable from other attenuation levels.

It is another object of the invention to reduce parasitic capacitances within a step attenuator.

It is another object of the invention to provide a step attenuator with minimized insertion losses.

SUMMARY OF THE INVENTION

The invention provides a step attenuator for use in attenuating an electromagnetic signal. The step attenuator includes a first path having a plurality of attenuator structures provided therein, each attenuator structure being selectively actuated to permit the signal to pass therethrough. A second path is disposed in parallel with the first path, the second path permitting the signal to selectively bypass the first path. A third path is disposed in series with the first and second paths and includes at least one attenuator structure that is selectively actuated to permit the signal to pass therethrough.

Additionally, the invention provides a high-power RF step attenuator. The attenuator includes a first path that has a plurality of attenuator structures provided therein, each attenuator structure being selectively actuated to permit an RF signal to pass therethrough. The first path has a selectively actuable first path input switch disposed at one end of the first path to selectively permit the signal to enter the first path. A second path is disposed in parallel with the first path. The second path permits the signal to selectively bypass the first path. A third path disposed in series with the first and second paths and includes at least one attenuator structure that is selectively actuated to permit the signal to pass therethrough. At least one of the attenuator structures further includes: a first switch disposed on an input side of the attenuator structure, the first switch selectively permitting the signal to enter the attenuator structure; a second switch disposed on an output side of the attenuator structure, the second switch selectively permitting the signal to exit the attenuator structure; a bypass line that permits the signal to bypass the first and second switches; and a third switch disposed along the bypass line to selectively permit the signal to pass through the bypass line. In one embodiment, there are a total of n attenuator structures, wherein a first attenuator structure provides p dB of attenuation to the signal. Each of the second through nth attenuator structures provides a level of attenuation that is substantially double (in dB) that of the previous attenuator structure such that the nth attenuator structure provides a level of attenuation equal to $2^{n-1}$p dB. The first attenuator structure and the nth attenuator structure are disposed within the third path.

DETAILED DESCRIPTION OF THE DRAWINGS

Figure 3:
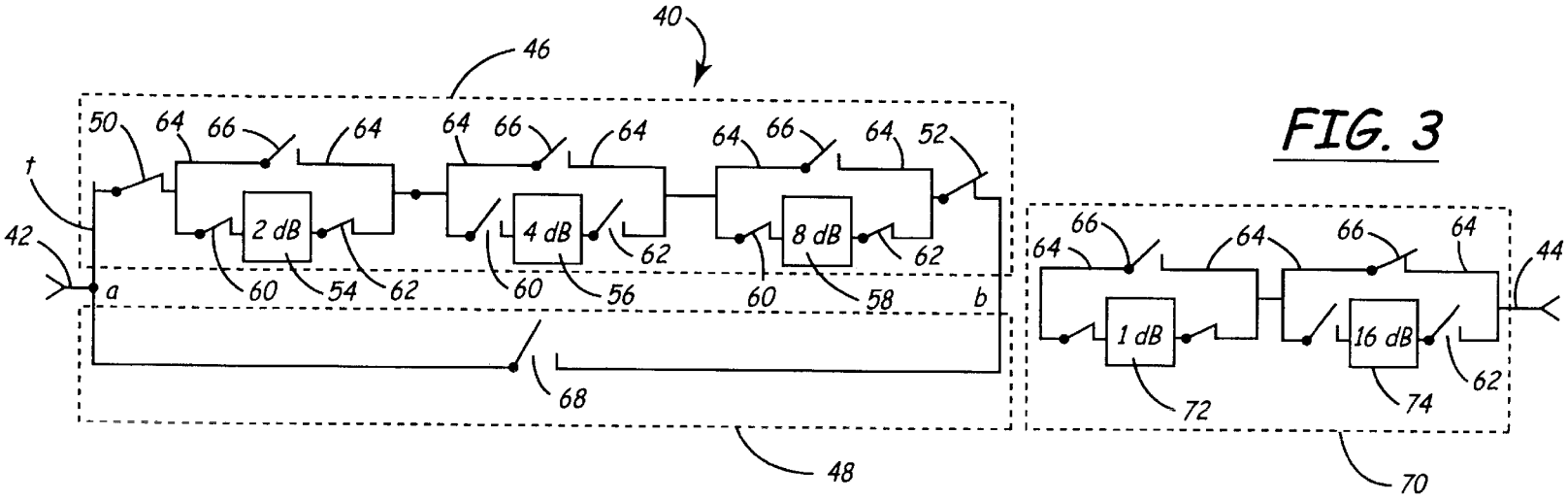
FIG. 3 is a schematic diagram of a step attenuator according to one embodiment of the invention.

FIG. 3 depicts a step attenuator 40 according to one embodiment of the invention. The step attenuator has an input 42 and an output 44. Electrically conductive transmission line t connects various switches and components between the input and the output. The step attenuator has a long path 46 and a short path 48 in parallel with each other. The long and short paths separate from each other at a junction a and rejoin at a junction b. A long path input switch 50 is situated within long path 46 adjacent junction a, and a long path output switch 52 is situated within long path 46 adjacent junction b. A plurality of attenuator structures or cells 54, 56, 58 are disposed in series between long path input switch 50 and long path output switch 52. Each attenuator cell has an attenuator cell input switch 60 and an attenuator cell output switch 62. Attenuator cell input and output switches 60, 62 selectively control the entry of an electromagnetic signal, such as an RF signal, into the respective attenuator cell. An attenuator cell bypass line 64 is disposed in parallel with each attenuator cell. An attenuator cell bypass switch 66 is disposed along attenuator cell bypass line 64 and permits the signal to selectively bypass the attenuator cell with which it is associated. Short path 48 bypasses long path 46 and has a short path switch 68 disposed along its length.

A common path 70 is selectively connected in series with either long path 46 or short path 48. Common path 70 includes a plurality of attenuator cells 72, 74 connected in series with each other. As with previously described attenuator cells 54, 56, 58, each attenuator cell 72, 74 has an attenuator cell input switch 60, an attenuator cell output switch 62, an attenuator cell bypass line 64, and an attenuator cell bypass switch 66 associated therewith. It should be noted that all switches in the embodiment depicted in FIG. 3 are preferably single-pole, single-throw (SPST) switches.

Each attenuator cell 54, 56, 58, 72 and 74 provides a predetermined level of attenuation to a signal passing therethrough. In the present embodiment, the following levels of attenuation are provided: attenuator cell 54, 2 dB; attenuator cell 56, 4 dB; attenuator cell 58, 8 dB; attenuator cell 72, 1 dB; and attenuator cell 74, 16 dB. By selectively actuating the previously described switches to permit the signal to pass through the appropriate attenuator cells, the signal may be attenuated from 0 to 31 dB in 1 dB steps. For example, if 11 dB of attenuation is desired, long path input and output switches 50, 52 are closed and short path switch 68 is opened. Attenuator cell input and output switches 60, 62 associated with attenuator cells 54, 58 and 72 are closed and bypass switches 66 associated with those attenuator cells are opened. Conversely, the attenuator cell input and output switches associated with attenuator cells 56 and 74 are opened and the bypass switches associated with those attenuator cells are closed. This combination of switch positioning, shown in FIG. 3, allows an electromagnetic signal such as an RF signal to pass through attenuator cells providing 2 dB, 8 dB and 1 dB of attenuation, thereby providing a total of 11 dB of attenuation.

Figure 4:
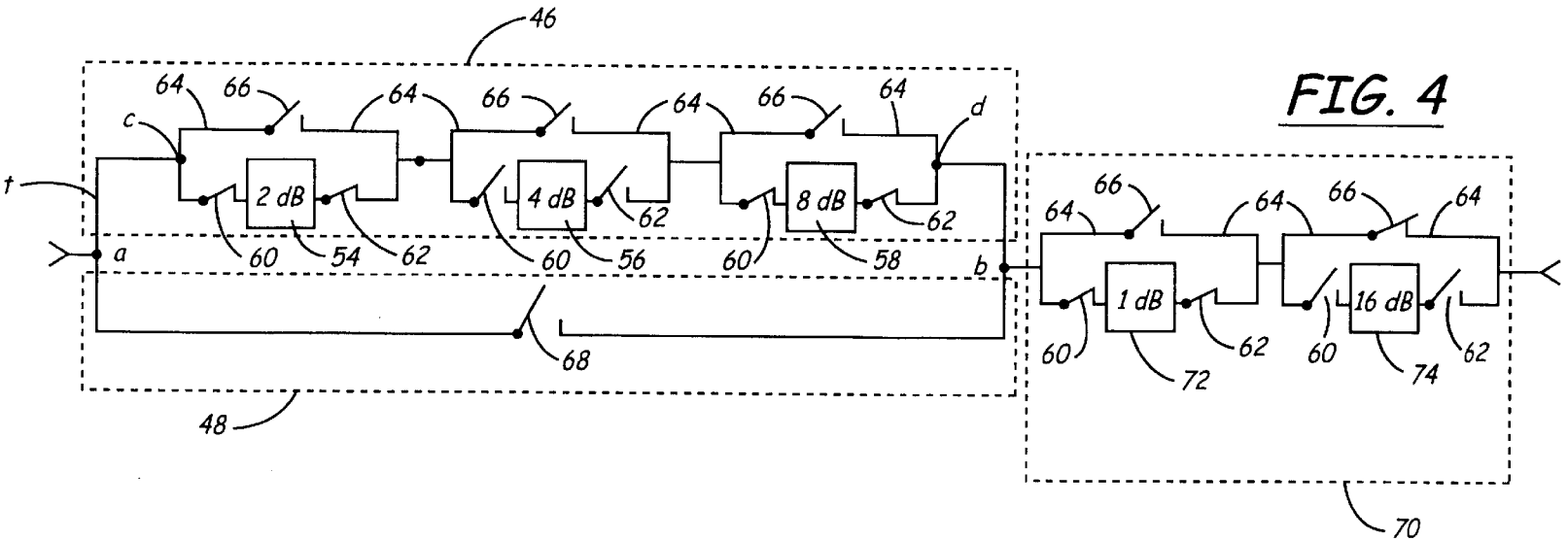
FIG. 4 is a schematic diagram of a step attenuator according to another embodiment of the invention.

FIG. 4 shows another embodiment of the invention in which long path input and output switches 50, 52 are eliminated. With fewer switches, the insertion loss in long path 46 and the step error between the long and short paths is reduced. To prevent a signal from passing through the long path, it is preferable for input switch 60 and bypass switch 66 associated with attenuator cell 54 and output switch 62 and bypass switch 66 associated with attenuator cell 58 to have a shunt-type PIN diode incorporated therein. If this is done, the length of the input transmission line ac—between junction a and junction c (which is where the long path splits between bypass line 64 and input switch 60 of attenuator cell 54)—is equal to $n\times(\lambda_1/2)$, where n=0, 1, 2, . . . , and $\lambda_1$ is the guided wavelength at the input transmission line ac. Furthermore, the output transmission line db—which is the transmission line between junction b and junction d (where the long path recombines bypass line 64 and output switch 62 of attenuator cell 58) should have a length of $n\times(\lambda hd\ 2/2)$, where n=0, 1, 2, . . . and $\lambda_2$ is the guided wavelength at output transmission line db. In this case, the above-named long path switches having shunt PIN diodes and guided quarter-wavelength lines 64 incorporated therein are connected an odd number of quarter-wavelengths away from the respective junctions a and b. Shunt PIN diodes 60, 66, 62 are arranged to be ON at the short path mode.

Figure 1:
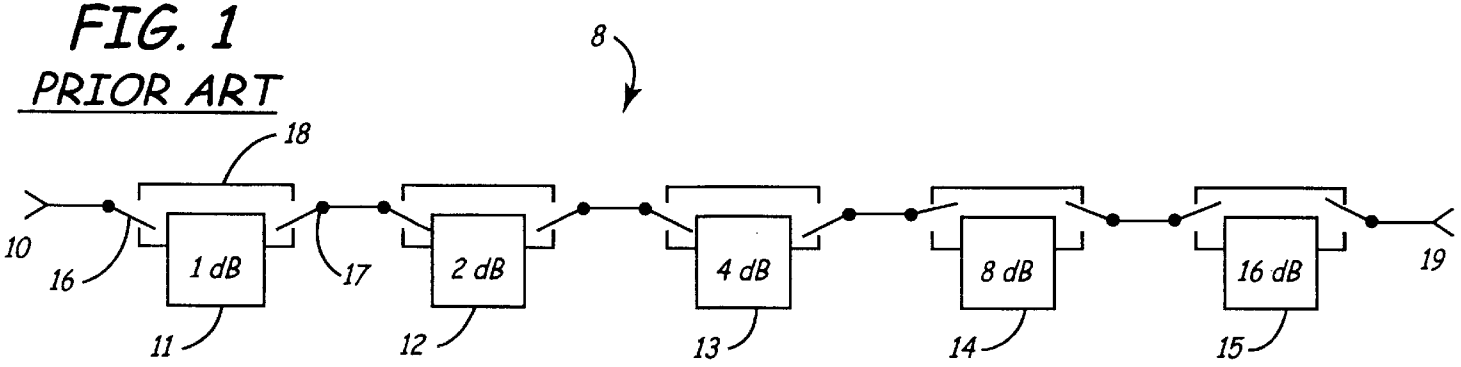
FIG. 1 PRIOR ART
FIG. 1 is a schematic diagram of a known step attenuator design.
Figure 2:
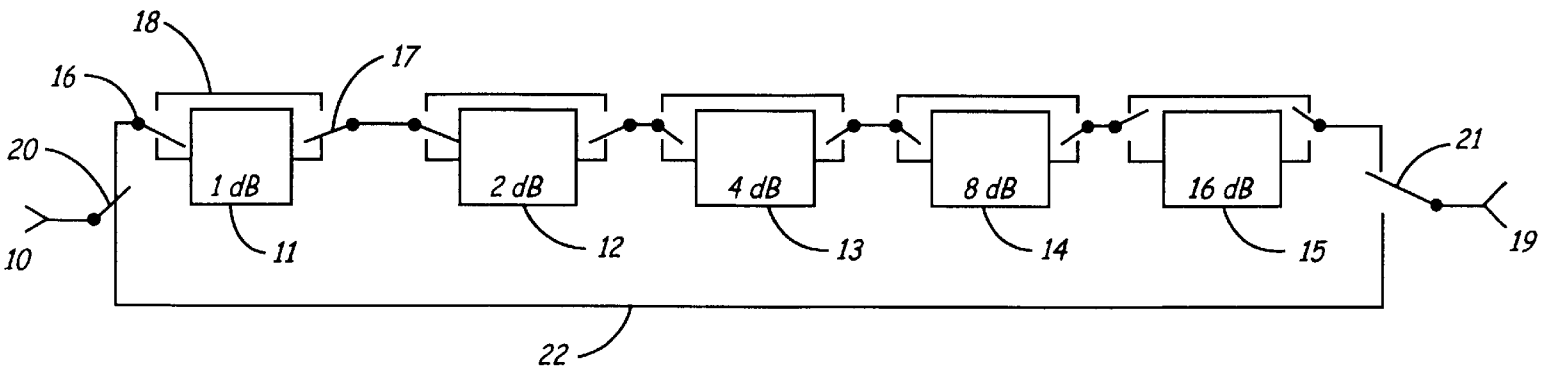
FIG. 2 PRIOR ART
FIG. 2 is a schematic diagram of another known step attenuator design.

Because attenuator cells providing 1 dB and 16 dB of attenuation are disposed within common path 70 (as shown in FIGS. 3 and 4), isolation requirements between long and short paths 46, 48 are reduced 17 dB when compared with the conventional step attenuator shown in FIG. 2. This permits size reduction and simplified construction. Furthermore, short path SPST switch 68 has low losses and required less isolation than the double-pole, double throw bypass switches 20, 21 that are used in a conventional step attenuator.

Figure 5:
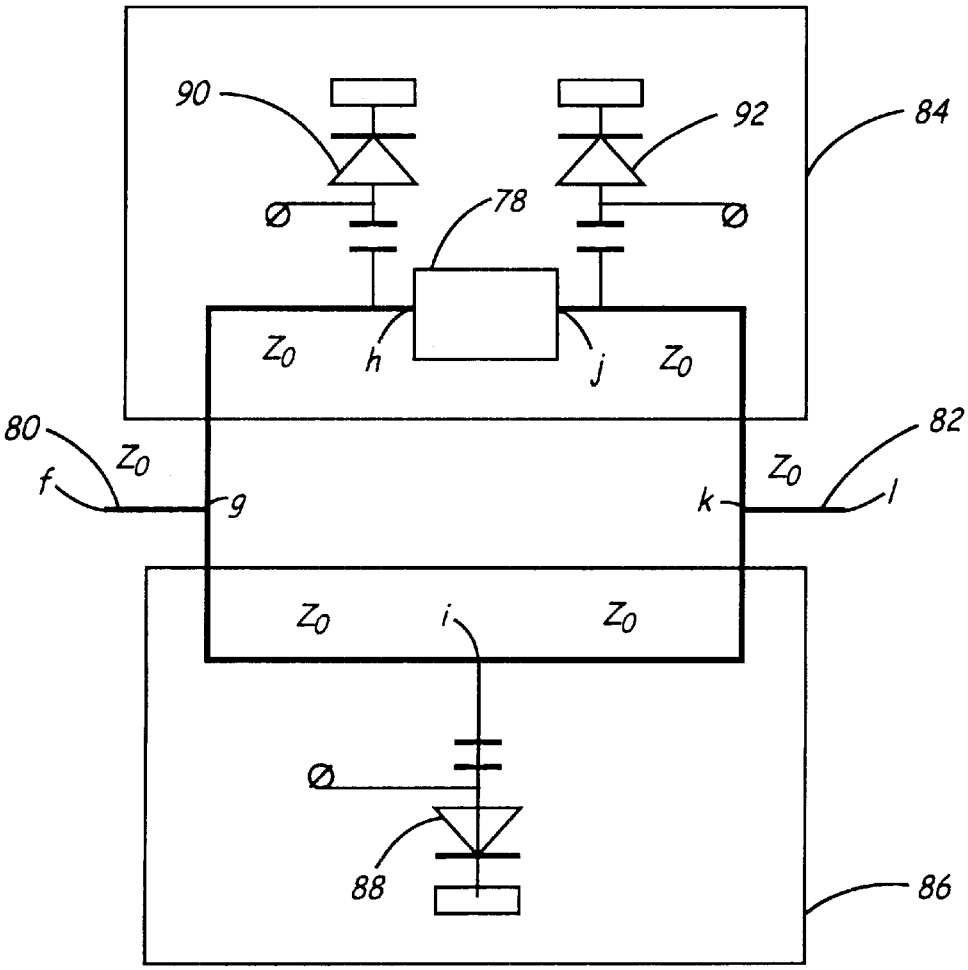
FIG. 5 is a schematic diagram of a switch channel attenuator section that may be used with the embodiments of the invention.

FIG. 5 shows a preferred schematic arrangement for an attenuator cell 78 that uses shunt PIN diodes as switches. A cell input transmission line 80 with impedance $Z_0$ is located at the input port f, which is upstream of a junction g. A cell output transmission line 82 with impedance $Z_0$ is located at the output port l, which is downstream of a junction k. Input transmission line 80 and output transmission line 82 are connected by an attenuation section 84 (indicated as passing through junctions g, h, j, and k) and a bypass section 86 (indicated as passing through junctions g, i and k), which is analogous to attenuator cell bypass line 64 in FIGS. 3 and 4. Bypass section 86 includes a shunt PIN diode 88 located at the center of the half-wavelength transmission line gik, which is so named because the length of gik is $\lambda_0/2$, where $\lambda_0$ is the guided wavelength at the transmission line. When diode 88 is forward-biased, a signal such as a RF signal is not permitted to flow through bypass section 86. When diode 88 is reverse-biased, the RF signal is permitted to flow through bypass section 86. Within attenuation section 84, two shunt PIN diodes 90, 92 are disposed a distance of one-quarter wavelength ($l_{l=\lambda 0}/4$) from junctions g and k, respectively. When diodes 90, 92 are reverse-biased, the RF signal passes through attenuator section 84 and is attenuated according to the insertion loss value of attenuator cell 78. When diodes 90, 92 are forward-biased, the RF signal does not pass through the attenuator section. Properly actuating or biasing diodes 88, 90 and 92 allows the direction of the RF signal exclusively and selectively through either the attenuation section or the bypass section.

For shunt PIN diode switches 88, 90, 92, the isolation is $$20 \log[1+(Z_0/2R_F)](\text{dB}), \quad (1)$$

and the insertion loss is $$10 \log[1+(Z_0/2X_c)^2](\text{dB}), \quad (2)$$

where $Z_0$ is the characteristic impedance of the input/output transmission line, $R_F$ is the diode resistance at under forward bias, $X_c=1/i\omega C_j$, and $C_j$ is the diode junction capacitance at under zero or reverse bias. It can be seen from Equations 1 and 2 that isolation is a function of the diode's forward resistance, and the insertion loss is primarily dependent of the junction capacitance. According to the invention, to minimize insertion loss through bypass section 86, PIN diode 88 needs to have low junction capacitance, and PIN diodes 90, 92 must exhibit low forward resistance. With respect to attenuation section 84, higher insertion loss of diodes 90, 92 with moderate junction capacitances should be compensated by correction of the insertion loss of attenuator cell 78.

A microstrip switch channel attenuator has been constructed according to FIG. 5. PIN diode 88 had $C_j$=0.5 pF and $R_F$=0.75Ω, and PIN diodes 90, 92 had $C_j$=0.9 pF and $R_F$=0.32Ω. At a frequency of 1 GHz, the insertion loss of the low loss path was 0.3 dB maximum and the return loss was 20 dB minimum. Of course, PIN diodes having other capacitance and resistance values may be used to achieve satisfactory results, consonant with the concepts disclosed herein.

The miniature microstrip L-band step attenuator requires a substrate having a high dielectric constant and a minimum thickness. As previously mentioned, parasitic capacitances between the pads of the electronic components (such as diodes, capacitors, resistors and the like) and the ground plane is a point of concern when using microstrip attenuators. Such parasitic capacitances cause additional losses, narrow the band of available frequencies, and require high manufacturing tolerances to compensate for higher sensitivity of error. To eliminate these problems, according to the present invention, the pads of the electronic components have no under-lying ground. Alternately, the grounded housing should be far from the printed circuit board, or there should be more underlying distance between the bottom of the substrate and the metal housing.

A 1 GHz microstrip high-power precision step attenuator has been built according to the embodiment shown in FIG. 3. The under-lying ground plane was far from the PIN diode and attenuator cell resistors. The step attenuator provided pulse power at 1.6 kW and attenuation in 1 dB steps, with increment error of +/−0.35 dB and minimum insertion loss of 1.05 dB.

An advantage of the invention is that the parasitic capacitances are greatly reduced because of the distance from the electronic components and the underlying ground plane. This in turn reduces increment error. The reduction in parasitic capacitance also reduces the need for additional tuning and matching elements and widens the available frequency bandwidth. The concomitant reduction in sensitivity means that the step attenuator may be manufactured with less exacting tolerances. The reduction in the number of tuning and matching elements also reduces the size and cost of the attenuator.

Another advantage of the invention is that increment error and insertion losses are reduced.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various elements, features, functions and/or properties disclosed herein. No single feature, function, element or property of the disclosed embodiments is essential to all of the disclosed inventions. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the invention of the present disclosure.

What is claimed is:

1. A step attenuator for use in attenuating an electromagnetic signal, comprising:

a first path having a plurality of attenuator structures provided therein, each attenuator structure being selectively actuated to permit the signal to pass therethrough;

a second path disposed in parallel with the first path, the second path permitting the signal to selectively bypass the first path; and a third path selectively disposed in series with one of the first and second paths and including at least one attenuator structure that is selectively actuated to permit the signal to pass therethrough;

wherein each of the attenuator structures has an input side and an output side, and wherein each of the attenuator structures further includes a first switch disposed on the input side of the attenuator structure, the first switch selectively permitting the signal to enter the attenuator structure, a second switch disposed on the output side of the attenuator structure, the second switch selectively permitting the signal to exit the attenuator structure, a bypass line that permits the signal to bypass the first and second switches, and a third switch disposed along the bypass line to selectively permit the signal to pass through the bypass line.

2. The step attenuator of claim 1, wherein the first, second and third switches are single-pole, single-throw switches.

3. The step attenuator of claim 1, wherein each of the first and third switches includes a diode for selectively permitting the signal to pass therethrough.

4. The step attenuator of claim 1, wherein the first and second switches and the attenuator structure are disposed on a transmission line, and wherein the bypass line splits from and rejoins the transmission line at first and second junctions, respectively, and further wherein the first switch is disposed at a distance from the first junction that is substantially a guided quarter-wavelength of the transmission line.

5. The step attenuator of claim 4, wherein the second switch includes a diode for selectively permitting the signal to pass therethrough, and wherein the diode is disposed at a distance from the second junction that is substantially a guided quarter-wavelength of the transmission line.

6. The step attenuator of claim 1, wherein the bypass line has a guided half-wavelength, and wherein the third switch is disposed halfway along the length of the bypass line.

7. The step attenuator of claim 1, wherein the first path has a first end, and further including:

a first path input switch disposed at the first end of the first path, the first path input switch being selectively actuable to permit the signal to enter the first path.

8. The step attenuator of claim 7, wherein the first path has a second end, and further including:

a first path output switch disposed at the second end of the first path, the first path output switch selectively actuable to permit the signal to exit the first path.

9. The step attenuator of claim 8, wherein at least one of the first path input switch and the first path output switch is a single-pole, single-throw switch.

10. The step attenuator of claim 1, further including a second path switch disposed along the second path, the second path switch selectively actuable to permit the signal to pass through the second path.

11. The step attenuator of claim 1, wherein there are a total of n attenuator structures, and wherein a first attenuator structure provides p dB of attenuation to the signal, and further wherein each of a second through nth attenuator structure provides a level of attenuation that is substantially double that of the previous attenuator structure, as measured in dB, such that the nth attenuator structure provides a level of attenuation equal to $2^{n-1}$p dB.

12. The step attenuator of claim 11, wherein the first attenuator structure and the nth attenuator structure are disposed within the third path.

13. The step attenuator of claim 1, wherein each of the attenuator structures within the first path provide an attenuation level that is within a first range, and wherein an attenuator structure within the third path provides an attenuation level that is within a second range, and further wherein the second range is less than the first range.

14. The step attenuator of claim 13, wherein another attenuator structure within the third path provides an attenuation level that is within a third range, and wherein the third range is greater than the first range.

15. The step attenuator of claim 1, wherein the attenuator structures attenuate high-power RF signals.

16. If The step attenuator of claim 1, wherein the step attenuator is disposed upon a microstrip.

17. A high-power RF step attenuator, comprising:

a first path having a plurality of attenuator structures provided therein, each attenuator structure being selectively actuated to permit an RF signal to pass therethrough, wherein the first path has a first end, and further including a selectively actuable first path input switch disposed at the first end of the first path to selectively permit the signal to enter the first path;

a second path disposed in parallel with the first path, the second path permitting the signal to selectively bypass the first path; and a third path selectively disposed in series with one of the first and second paths and including at least one attenuator structure that is selectively actuated to permit the signal to pass therethrough;

wherein each of the attenuator structures has an input side and an output side, and wherein each of the attenuator structures further includes a first switch disposed on the input side of the attenuator structure, the first switch selectively permitting the signal to enter the attenuator structure;

a second switch disposed on the output side of the attenuator structure, the second switch selectively permitting the signal to exit the attenuator structure;

a bypass line that permits the signal to bypass the first and second switches; and a third switch disposed along the bypass line to selectively permit the signal to pass through the bypass line.

18. The step attenuator of claim 17, further including a second path switch disposed along the second path, the second path switch selectively actuable to permit the signal to pass through the second path.

19. A high-power RF step attenuator, comprising:

a first path having a plurality of attenuator structures provided therein, each attenuator structure being selectively actuated to permit an RF signal to pass therethrough;

a second path disposed in parallel with the first path, the second path permitting the signal to selectively bypass the first path; and a third path selectively disposed in series with one of the first and second paths and including at least one attenuator structure that is selectively actuated to permit the signal to pass therethrough;

wherein each of the attenuator structures has an input side and an output side, and wherein at least one of the attenuator structures further includes:

a first switch disposed on the input side of the attenuator structure, the first switch selectively permitting the signal to enter the attenuator structure;

a second switch disposed on the output side of the attenuator structure, the second switch selectively permitting the signal to exit the attenuator structure;

a bypass line that permits the signal to bypass the first and second switches; and a third switch disposed along the bypass line to selectively permit the signal to pass through the bypass line;

wherein there are a total of n attenuator structures, and wherein a first attenuator structure provides p dB of attenuation to the signal, and further wherein each of a second through nth attenuator structure provides a level of attenuation that is substantially double that of the previous attenuator structure, as measured in dB, such that the nth attenuator structure provides a level of attenuation equal to $2^{n-1}$p dB, and further wherein the first attenuator structure and the nth attenuator structure are disposed within the third path.

* * * * *